US005484334A

United States Patent [19]

Evdokimo

[11] Patent Number: 5,484,334

[45] Date of Patent: Jan. 16, 1996

[54] COIN HANDLING APPARATUS WITH COIN FILTER AND IMPROVED COIN INTERLOCK

[76] Inventor: Allen J. Evdokimo, 1720 Terrace Heights La., Reno, Nev. 89523

[21] Appl. No.: 221,727

[22] Filed: Apr. 1, 1994

[51] Int. Cl.[6] ..... G07D 3/00

[52] U.S. Cl. ..... 453/3; 453/57; 221/203; 221/267

[58] Field of Search ..... 453/3–9, 12, 13, 453/32, 33, 34, 35, 40, 49, 57; 221/203, 267

[56] References Cited

U.S. PATENT DOCUMENTS

| | | | |
|---|---|---|---|
| 4,275,751 | 6/1981 | Bergman | 453/32 X |
| 4,598,724 | 7/1986 | Boland | 453/32 |
| 4,923,430 | 5/1990 | Iimura | 221/267 X |
| 4,978,322 | 12/1990 | Paulsen | 453/57 |

FOREIGN PATENT DOCUMENTS

| | | | |
|---|---|---|---|
| 2185341 | 7/1987 | United Kingdom | 453/57 |

*Primary Examiner*—F. J. Bartuska

[57] ABSTRACT

A coin handling apparatus for transporting coins from a hooper location through a transfer station to an ejection site. The apparatus has a first rotatable disc assembly with a coin inlet filter for filtering out oversized or bent coins. An undersized coin slot located along a transport path permits smaller coins than the desired denomination to pass therethrough out of the coin transport path. The coin transfer station includes a knife edge for directing the coins into the inlet of a coin tower in such a manner that the coins are forced upwardly toward an outlet. Along the transport path the coin are constrained both in a radial direction and a lateral direction to prevent jamming. A coin interlock mechanism located in the escalator prevents theft of the coins via the outlet. The interlock mechanism includes a sliding and pivoting interlock member which can only be successfully operated from below by an advancing coin.

45 Claims, 14 Drawing Sheets

COIN HANDLING APPARATUS WITH COIN FILTER AND IMPROVED COIN INTERLOCK

BACKGROUND OF THE INVENTION

This invention relates generally to coin handling apparatus, and more specifically to coin handling apparatus used to transfer coins from a coin hopper to a coin ejection location.

Many coin handling devices are known which are used for the transport of coins along a transport path between a storage hopper and a coin ejection location. Typical coin handling devices of this type are found in gaming machines which receive individually deposited coins in a hopper and transport a controlled number of coins in serial fashion from the bulk coin mass to an ejection location, whence the coins are received in a user accessible payout tray. Such coin handling devices typically include a hopper mounted to a base plate, the hopper providing the bulk mass coin storage, an agitator for stirring the coins in the bulk mass, a rotatable pin wheel, a rotatable transport mechanism for receiving individual coins from the mass and transporting the individual coins to a transfer station, and a coin escalator having an inlet adjacent the transfer station and a remote outlet from which coins are serially ejected when a payout is required. The coin escalator typically includes an elongate housing defining a coin chute, an optical or mechanical counting mechanism positioned at some location along the chute (typically near the outlet) for counting the number of coins ejected, and an interlock mechanism for deterring theft of coins from the upper end of the chute.

Despite the myriad designs which have been proposed, existing coin handling devices typically suffer from one or more of the following disadvantages. The first disability is relatively poor coin agitation. With known devices using the pin wheel design, the pin wheel must be uncovered in order to load coins on the pins which are located near the periphery of the pin wheel. Consequently, only the center portion of the pin wheel is available to provide the necessary coin agitation, and this is where the agitator is typically located, usually in the form of a star wheel or radially extending arms of other geometrical configurations. While this arrangement can sometimes provide effective coin agitation when the hopper is relatively full, the effectiveness of the agitation decreases as the level of the coin mass in the hopper bowl drops. In some designs, once the level of the coin mass falls below some threshold, coin agitation ceases even though there are still a relatively large number of coins in the hopper bowl. As a consequence, the coin handling apparatus is automatically disabled prematurely, necessitating a shutdown of the associated device (e.g. slot machine), which is undesirable. The second disadvantage with many known designs lies in a relative susceptibility to coin jams. It is generally acknowledged that the leading cause of failure for coin handling devices in the gaming industry is the condition known as a coin jam, of which there are three most frequent varieties: bowl jams, bent coin jams, and coin entry jams. Bowl jams occur when the coins in the hopper are agitated in such a fashion that a wedge effect is created between the bowl flange and the hopper housing. This wedge effect is stronger than the rotational force available from the drive motor (which rotates the pin wheel and agitator), as a consequence of which the apparatus is automatically disabled. Once disabled, the coin jam must be cleared by a service technician and reset for operation, which is undesirable due to the attendant down time of unknown length. Bent coin jams are caused by bent coins in the coin mass which can either cause a bowl jam or a coin jam at the transfer station at the inlet to the escalator. Coin entry jams are jams which occur at the transfer station between the pin wheel and the inlet to the coin escalator and, in addition to bent coins, are caused by failure to constrain motion of the coin at the transfer station within relatively precise lateral and radial dimensions as the coin transfers from the rotating pin wheel to the escalator inlet. A coin entry jam typically damages both the coin and the escalator inlet.

A third disadvantage with known designs lies in the vulnerability of individual coins to theft from the escalator outlet. Since the escalator outlet is typically accessible to a user, a variety of methods have been developed to steal coins from the escalator. One method employs the use of a thin instrument to hold open the escalator coin ejection device (sometimes termed a "kicker") as coins are being fed from the hopper, up the escalator and out the outlet. According to this method, the thin instrument is used to hold the moving kicker, which is mounted on the outside of the escalator, in the open position thereby allowing coins to move freely from the outlet. Although many gaming machines currently in use automatically disable operation after a predetermined time period if the kicker is blocked open, this does not prevent the theft of several coins. In addition, for gaming machines with such an automatic shutdown feature, the machine remains inoperative until a service technician arrives to inspect and reset the operation of the machine. A second method of coin theft employs a small flashlight to constantly illuminate the optoelectronic coin counter located near the outlet of the escalator to defeat the counting function afforded by such devices. In many gaming machines in use today, continued payout of coins for a predetermined period of time results in automatic shutdown of the device, with the same disadvantages as those noted previously. A third method, which is also popular, involves the theft of the top coin nested inside the escalator. This is typically done by means of a tool fashioned by the user to extend into the outlet and to the back of the escalator chute and to engage the back surface of the top coin in the chute. By manipulating the tool toward the outlet, the coin is forcibly ejected. In more sophisticated gaming machines, this results in the generation of a hopper error signal which disables the machine and requires a service call.

Efforts to devise a coin handling apparatus devoid of the above disadvantages have not met with success to date.

SUMMARY OF THE INVENTION

The invention comprises a relatively low cost, simple and rugged coin handling apparatus for transporting coins from a bulk mass in the hopper bowl to a coin ejection location, which provides superior coin agitation, substantially reduces susceptibility to coin jams, and substantially increases anti-theft protection for coins in the escalator.

In its broadest aspect, the invention comprises a coin handling apparatus which includes a base plate, a hopper mounted to the base plate for storing coins in bulk, a coin feeder assembly rotatably mounted with respect to the base plate for transporting coins from the hopper along a transport path to a transfer station, and a coin escalator secured to the base plate adjacent the transfer station for providing ejection of coins in serial fashion at a location removed from the transfer station. The hopper has a lower slot for permitting undersized coins to exit the hopper during agitation. The coin feeder assembly includes an agitator/coin filter device for rejecting coins having a predetermined characteristic, such as an oversized diameter or a bent coin condition, and a coin transport disc secured to the coin filter for carrying coins entering through the filter along the transport path. The agitator/coin filter device preferably comprises an agitator disc, and a coin filter disc having an internal diameter and a filter surface facing the agitator disc, the filter surface including lands and grooves defining coin inlets when the coin filter disc is secured to the agitator disc. The agitator disc has an inner surface, an outer surface and a diameter at least as large as the inner diameter of the coin filter disc, the outer surface of the agitator disc having a plurality of raised portions extending therealong to promote coin agitation within the hopper. The plurality of raised portions extends radially along the outer surface of the agitator disc, preferably from the center to the periphery of the agitator disc outer surface. The coin inlets preferably have a predetermined geometry dimensioned to reject coins with at least one of the predetermined characteristics.

The coin transport disc has a plurality of peripherally distributed coin stops located adjacent the outer diameter thereof, the coin stops being pin-shaped, L-shaped, an arcuate segment or a combination of a pin and an arcuate segment. The coin transport disc further includes a plurality of coin guides positioned radially inwardly of the coin stops, the coin guides preferably having an inverted triangular sectional shape with the base of each inverted triangle having an arcuate shape.

A knife edge secured to the base plate extends laterally along the transfer station, the knife edge preferably having an arcuate surface with a radius of curvature closely matched to the radius of curvature of the arcuate surface of each of the triangular coin guides.

The coin filter disc and the coin transport disc have facing surfaces arranged along the periphery thereof which define a registration space for limiting lateral motion of coins transported along the transport path. The coin guides positioned radially inwardly of the outer diameter of the coin transport disc each has a guide surface at the outer end thereof for limiting inward radial motion of coins transported along the transport path. The inside radius of a mounting collar positioned over the coin filter and the coin transport disc limits outward radial motion of the coins transported along the transport path until the angular position at which gravity affixes the coins on the outer edge of the coin guides positioned radially inwardly of the outer diameter of the coin transport disc.

The coin escalator includes a housing with inner wall surfaces defining a coin chute having an inlet adjacent the transfer station and an outlet, and a coin interlock mechanism adjacent the outlet. The coin interlock mechanism includes an interlock bar slidably and pivotally mounted to the coin escalator within the chute, the interlock bar having a protruding nose portion extending towards the outlet, and bias means coupled to the interlock bar for biasing the interlock bar to a position in which the nose portion extends partially across the chute to a coin blocking position. The coin escalator housing is provided with a pair of guide grooves adjacent the outlet, a first lower one of the guide grooves having a shape permitting motion of the interlock bar generally parallel to the chute and a second upper one of the guide grooves having a shape permitting both motion generally parallel to the chute and motion laterally of the chute in a direction away from the outlet once the interlock bar has been translated to a predetermined position in the chute. The interlock bar is provided with a pair of axles arranged for sliding and pivoting motion within the guide grooves. A rotatable interference stop is located within the escalator and extends laterally of the chute at the outlet at a position located opposite the interlock mechanism.

Superior coin agitation is provided by the combination of the agitator surface and the lands and grooves located on the filter surface of the agitator coin filter device, which provides effective coin agitation from the rotational center of the coin filter to essentially the outer periphery thereof. Undersized coins are eliminated from the transport path by passing through the undersized coin rejection slot in the hopper. Because the coin filter rejects both oversized and bent coins, bent coin jams are substantially eliminated, since bent or oversized coins cannot reach the coin transport disc at all. In addition, coin entry jams are substantially eliminated by virtue of the close constraint on lateral and radial motion of coins along the transport path afforded by the facing surfaces of the coin filter disc and coin transport disc, the internal radius of the mounting collar and the coin guide arcuate surfaces, which co-act to limit lateral and radial coin movement. Coin theft is substantially eliminated by the mechanical interlock arrangement which prevents a coin from being pulled out of the escalator outlet using any type of tool. In addition, the interlock mechanism has no moving parts accessible from outside the escalator housing surface. Consequently, the mechanism cannot be held in an open condition by an externally applied tool. Also, when an optoelectronic counting sensor is installed with the invention, the optical components are secured within a housing which shields the optical detector from all light sources other than the dedicated radiation source.

For a fuller understanding of the nature and advantages of the invention, reference should be had to the ensuing detailed description taken in conjunction with the accompanying drawings.

DETAILED DESCRIPTION OF THE PREFERRED EMBODIMENTS

Figure 1:
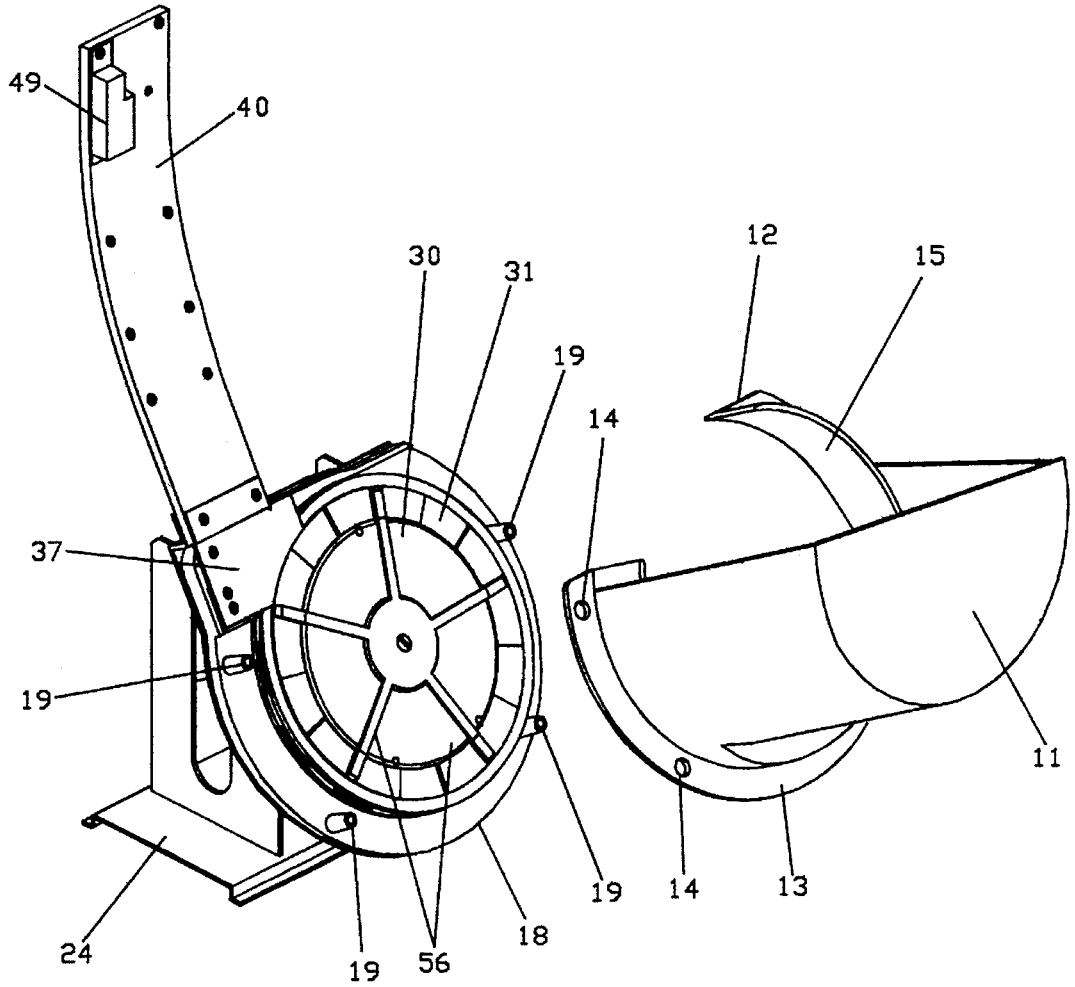
FIG. 1 is a perspective view of the preferred embodiment of the invention with the hopper removed.
Figure 2:
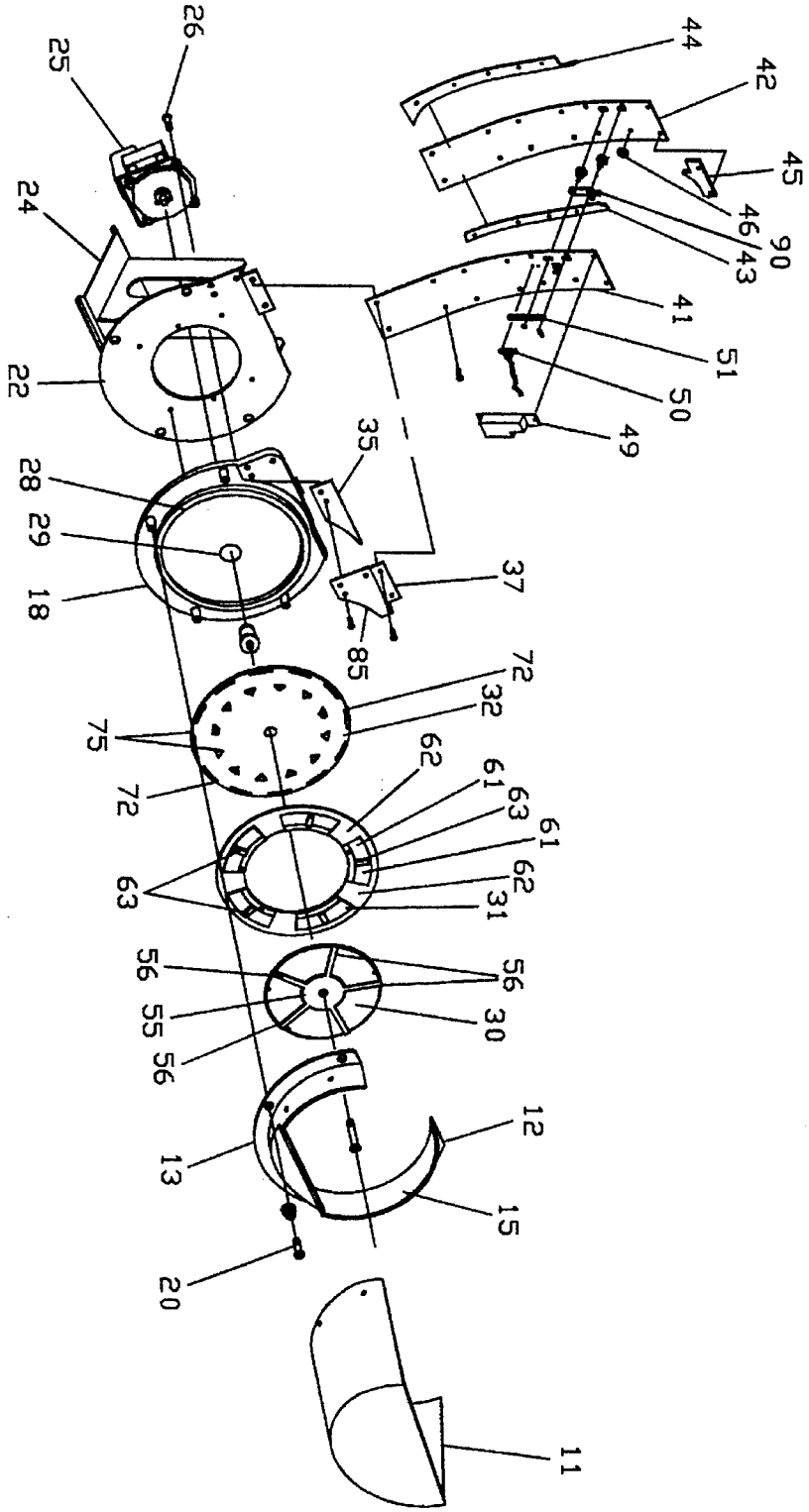
FIG. 2 is an exploded view of the embodiment of FIG. 1.

Turning now to the drawings, FIGS. 1 and 2 illustrate the preferred embodiment of the invention. As seen in these figs., a hopper bowl 11 is secured to a mounting collar 12 to form a hopper bowl assembly. Mounting collar 12 has a radially extending flange portion 13 having apertures 14 for mounting purposes, and an axially extending rim portion 15 for snugly receiving the inner periphery of hopper bowl 11 and for defining the outer limit of a circular coin transport path. The hopper bowl assembly comprising elements 11 and 12 is secured to a mounting plate 18 having a plurality of standoffs 19, each standoff 19 having a throughbore for enabling a plurality of fasteners 20 (see FIG. 2) to secure mounting collar 12 and mounting plate 18 to a base plate 22. Base plate 22 is secured to a base member 24 at an angle with respect to vertical, and an electrically driven motor unit 25 is secured to the rear of mounting plate 18 by means of suitable fasteners 26.

Mounting plate 18 has an axially extending peripheral flange 28 and a floor portion with an aperture 29 for enabling the shaft of motor unit 25 to be secured to a coin transport assembly comprising an agitator 30, a coin filter 31 and a coin transport disc 32. Secured to a corner of base plate 18 is a knife edge member 35 and a cover plate 37 forming a coin transfer station. Secured to the upper edge of base plate 22 is a coin escalator assembly generally designated with reference numeral 40 and comprising front and back plates 41, 42, side spacer members 43, 44, an outlet spacer 45, a fixed position rotatable abutment member 46, and a coin interlock mechanism described in detail below with reference to FIGS. 8–11. An optoelectronic counter 50 is secured to the outside surface of front plate 41 in registration with a counting arm 51 which blocks the light path between the light source and the light sensor, both of which are mounted in the optoelectronic device, for a short period of time and for the purpose of counting coins exiting from the escalator outlet. Cover 49 completely shields the optoelectronic counter from all light sources other than the dedicated light source. The optoelectronic counter is also immune to irradiation from within the chute defined by the spaces between elements 41–44.

Agitator 30 comprises a disc having a substantially flat inner surface (not illustrated) and an outer surface having a central hub portion 55 and a plurality of radially extending agitator arms 56 which extend from the hub portion 55 to the edge of the disc.

Coin filter 31 has a plurality of lands 61 and grooves or recessed portions 62, as well as a plurality of raised arm segments 63 which are peripherally distributed about coin filter 31 at angular locations matching the locations of arm portions 56 of agitator disc 30. When agitator disc 30 and coin filter 31 are mated together and secured to coin transport disc 32, lands 61 and grooves 62 in combination with the inner surface of agitator disc 30 form coin inlet apertures which allow the passage of coins into the interior of the volume defined by elements 30–32. The dimensions of the lands 61 and grooves 62 are selected such that only coins up to a maximum diameter and thickness are permitted to migrate into the interior of the assembly. Thus, a coin of a larger than permitted denomination or a bent coin cannot enter the assembly interior.

Figure 3:
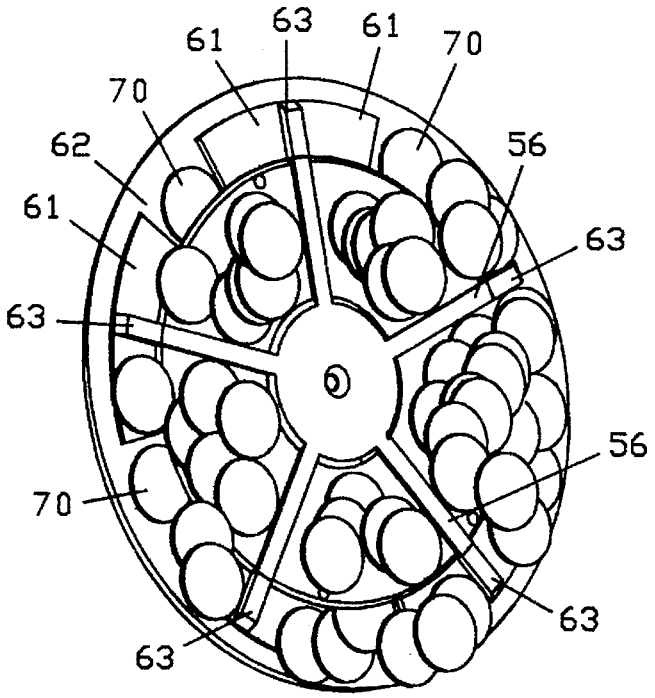
FIG. 3 is a perspective view of the agitator/inlet assembly illustrating coin agitation.
Figure 4:
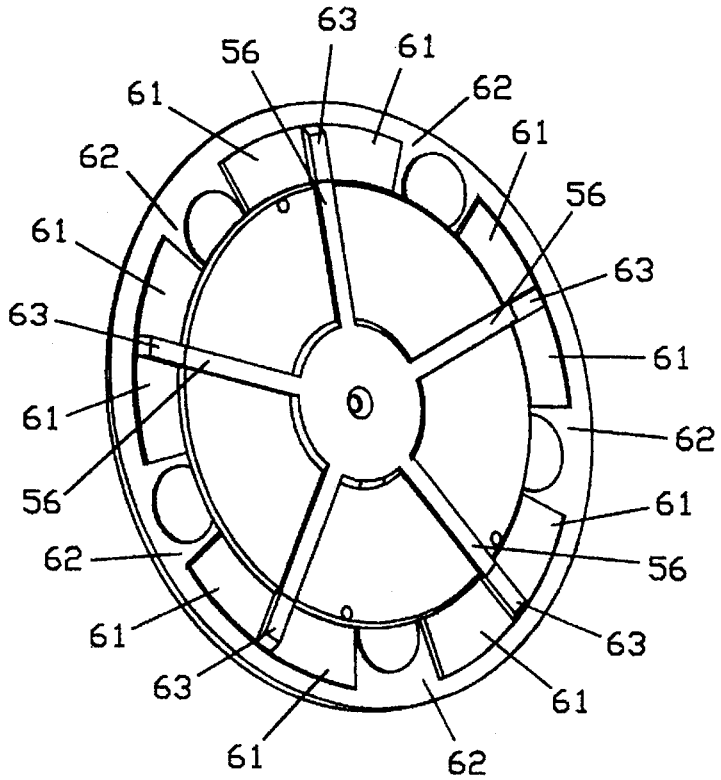
FIG. 4 is a view similar to FIG. 3 illustrating the location of the coin inlets.

This principle is illustrated in FIGS. 3 and 4. FIG. 3 illustrates a coin mass distributed on the outer surface of agitator 30 and coin filter 31 resulting from rotation of the assembly through a coin mass positioned in the hopper bowl assembly. As seen in FIG. 3, coins are randomly distributed in the recessed areas between the agitator arm portions 56 and extensions 63. Under gravity and the influence of the rotary motion, individual coins 70 migrate into the coin inlets and drop under the influence of gravity into the interior of the coin transport assembly. Neither an oversized coin nor a bent coin can pass through the coin inlet. Consequently, coins with such characteristics are rejected.

Figure 6:
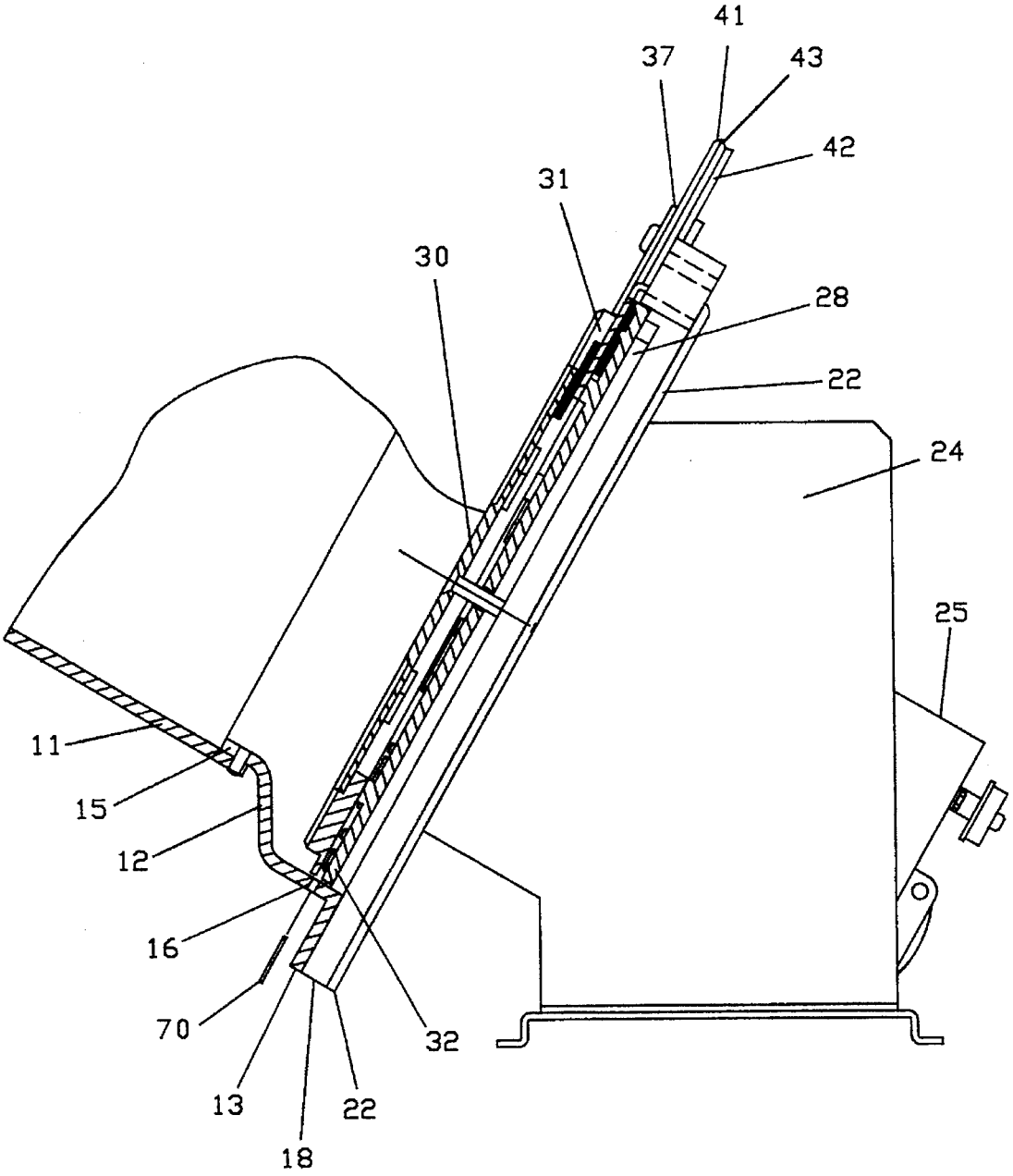
FIG. 6 is an enlarged view in section illustrating undersized coin rejection.

In addition, the invention provides for rejection of undersized coins in the following fashion. With reference to FIG. 6 which is an enlarged sectional detail view of the lower portion of the mounting collar 12 and the coin transport mechanism, a slot 16 is formed in mounting collar 12 just outboard of the flange portion 13 at the approximate six o'clock position for collar 12 when mounted to base plate 22. Slot 16 is formed to dimensions which are marginally smaller than the authorized coins for which the invention is designed. Consequently, any undersized coin which enters the internal volume of the coin transport assembly through a coin inlet migrates to the bottom and drops through slot 16 into an associated receptacle (not shown).

Figure 5:
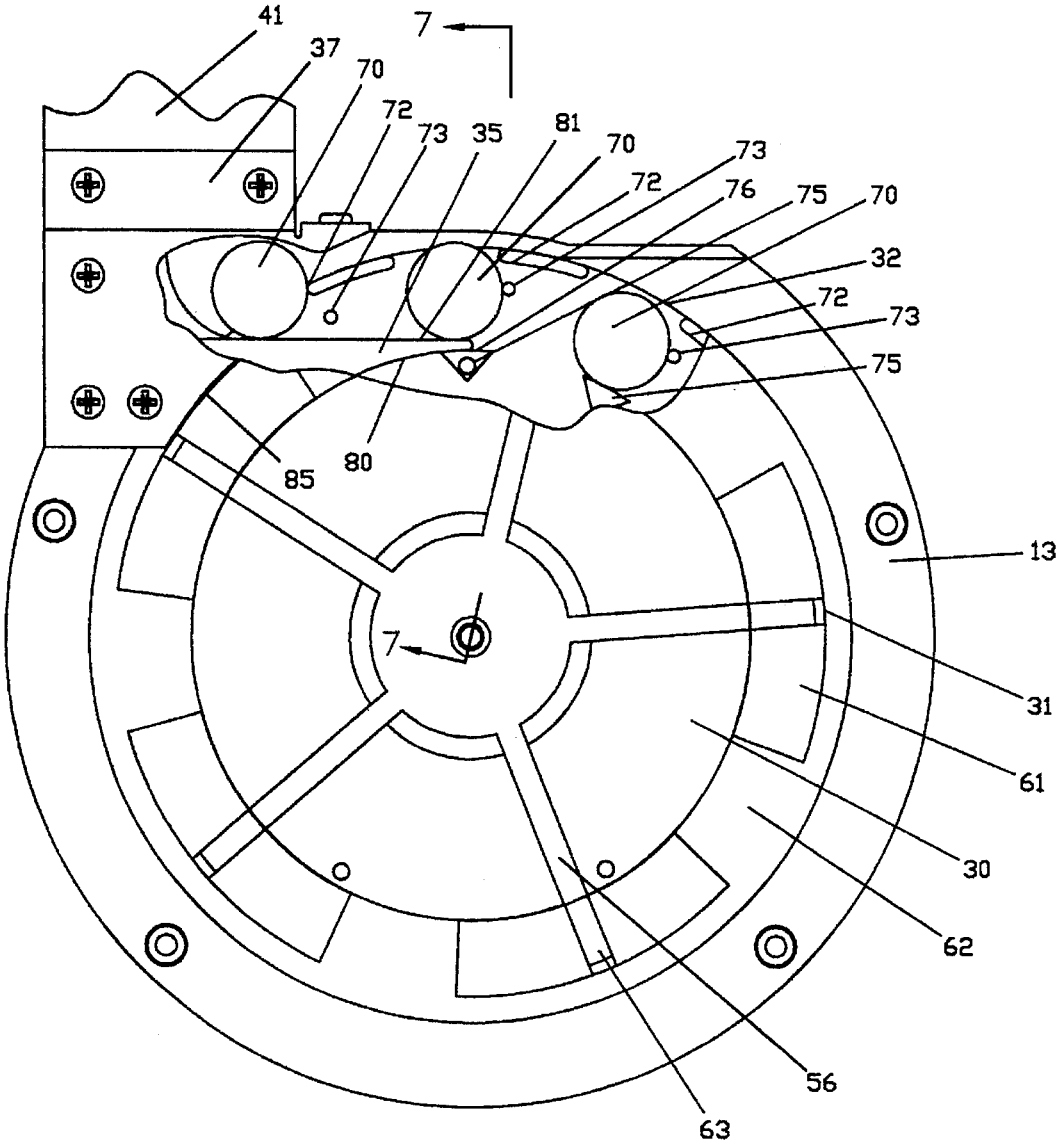
FIG. 5 is an enlarged front plan view partially broken away illustrating the transitional coin path to the coin escalator inlet.

Coin transport wheel 32 comprises a disc having a diameter essentially equal to the diameter of coin filter 31. The diameter of disc 32 is greater than the inner diameter of mounting plate flange 28 so that the surface of flange 28 limits the position of disc 32 in the inward axial direction. As best seen in FIGS. 2 and 5, coin transport disc 32 has a plurality of coin stops, distributed about the periphery thereof. In the embodiment shown in FIGS. 2 and 5, each of the coin stops comprises an arcuate segment 72 and a pin 73 located near the leading end of the associated segment 72 and radially inwardly thereof. As illustrated in FIG. 5, segments 72 and pins 73 act in concert to push a coin 70 along the transport path when coin transport disc 32 is rotated in the counterclockwise direction as viewed in FIG. 5. Coin transport disc 32 is also provided with a plurality of coin guides 75 distributed about the center of disc 32 at a radial distance inwardly of coin stops 72, 73. In the embodiment shown in FIG. 5, each guide 75 is generally triangular in shape and has an outer surface 76 which is arcuately shaped in a manner closely matching the radius of curvature of lower arcuate edge 80 of coin knife 35. The angular space between adjacent guides 75 is sufficiently great to permit a coin of the desired denomination to pass therebetween and lodge against the leading edges of coin stops 72, 73. Any undersized coin will pass between the trailing and leading edges of segments 72, and exit via slot 16.

Knife edge 35 has an upper essentially horizontal surface 81 on which the coin edge can ride as the coin transits from the coin transport disc to the inlet of the coin escalator 40, in the manner described below.

The cover plate 37 has an arcuate surface 85 which matches the curvature of the outer edges of lands 61 formed at the outer surface of coin filter 31 and provides an inner guide surface for limiting the outward axial motion of the periphery of coin filter 31 during operation.

Figure 7:
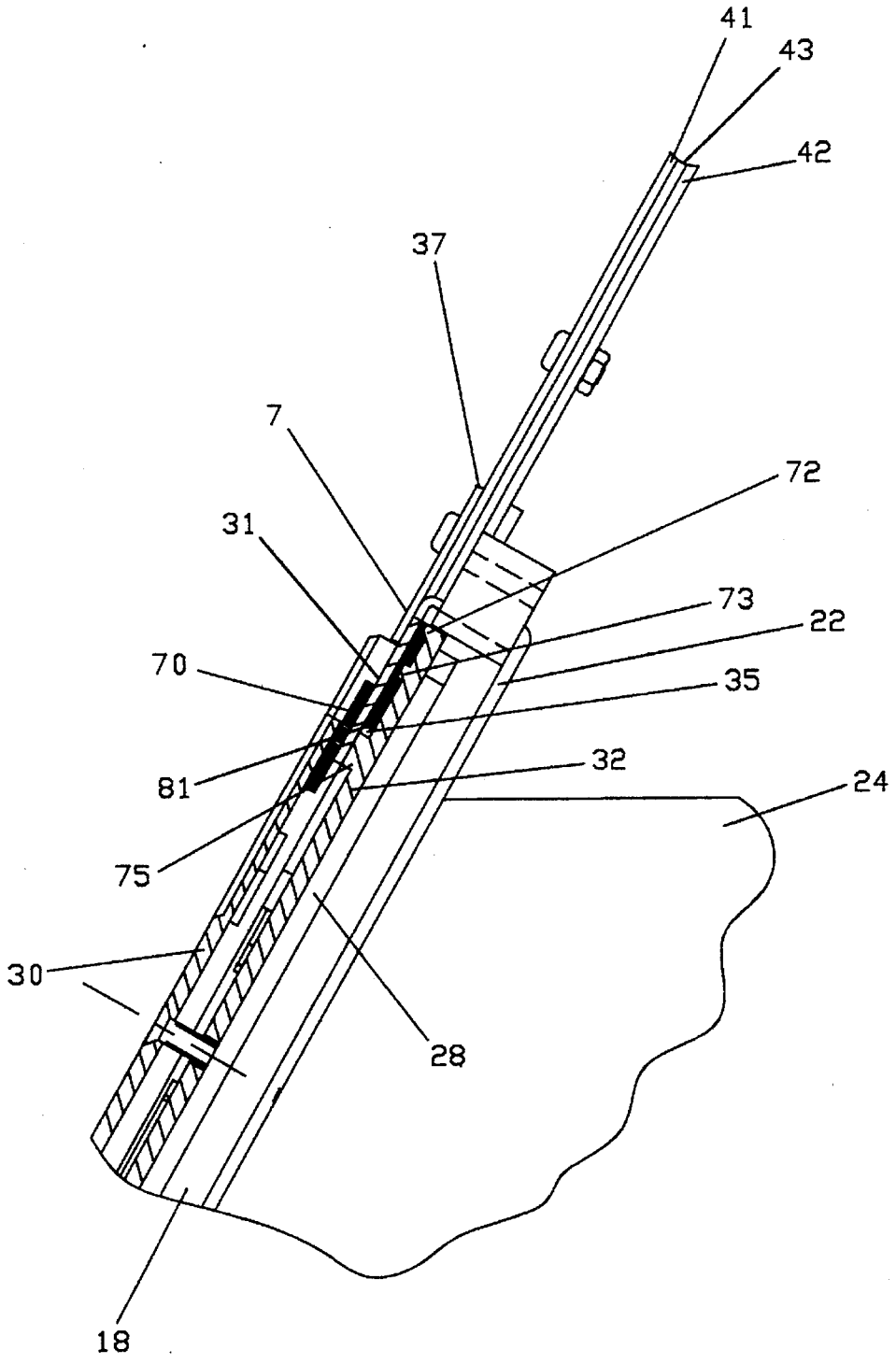
FIG. 7 is a sectional view taken along lines 7—7 of FIG. 5 illustrating coin confinement at the transfer station.

In use, with a coin mass in the hopper assembly 11, 12, when motor 25 is activated, the coin transport assembly comprising elements 30–32 is rotated in the counterclockwise direction as viewed in the figs. As the assembly rotates, the coin mass is agitated by arm portions 56 and arm segments 63 to distribute coins about the outer surface of the assembly. Some coins will migrate into the inlets and pass into the interior volume between elements 30, 31 and 32. Those coins which are oversized or bent cannot pass through the inlets and are consequently rejected automatically. The coins entering the interior volume of the assembly 30-32 migrate downwardly through the interstices between guides 75 and lodge against the leading edges of segments 72 and pins 73. Any undersized coin will drop through slot 16 in the hopper assembly and lodge in an associated receptacle (not shown). As the coin is raised by the rotation of the assembly, the coin is pushed along the circular transport path by the leading edges of a segment 72 and pin 73, and is also supported by the outer surface 76 of a guide 75. When the coin reaches the transfer station, the forward edge of the knife edge member 35 is encountered by the coin edge and the coin is transferred to the linear path defined by the upper surface 81 of the knife edge member 35 and enters the inlet of the coin escalator 40. During the critical transition along the knife edge, radial notion of the coin is restrained in the inner radial direction initially by outer surface 76 of inner member 75 and in the outer direction by the force of gravity. Lateral motion of the coin is restrained by the inner facing surfaces of coin filter 31 and coin transport disc 32 (see FIG. 7). Thus, the coin is confined to relatively limited motion in the radial direction and also in the direction perpendicular to the surface of the coin. As the coin transits along the knife-edge surface 81, it enters the inlet of the escalator.

As will be apparent to those skilled in the art, the invention not only limits radial and orthogonal (axial) movement of coins 70 during transport along the transport path to the inlet of the coin escalator 40, but also is constructed and arranged in such a way as to substantially reduce or eliminate entirely tolerance build-up across the individual components. More particularly, the cover plate 37 controls the forward axial location of the rotating coin filter 31, the knife edge member 35 controls both the rearward location of the coin filter 31 and the forward axial position of the coin transport disc 32. Mounting plate 18 controls the axial rearward Location of the coin transport disc by means of flange 28, and the overall reference locations of cover plate 37 and knife edge member 35. This arrangement provides the advantage of maintaining design tolerances in a reliable manner during production of the individual components, due in particular to the repeatable accuracy in the manufacture of precision plastic and metal parts. This is a significant advantage when manufacturing coin handling apparatus in high volume.

Figure 8:
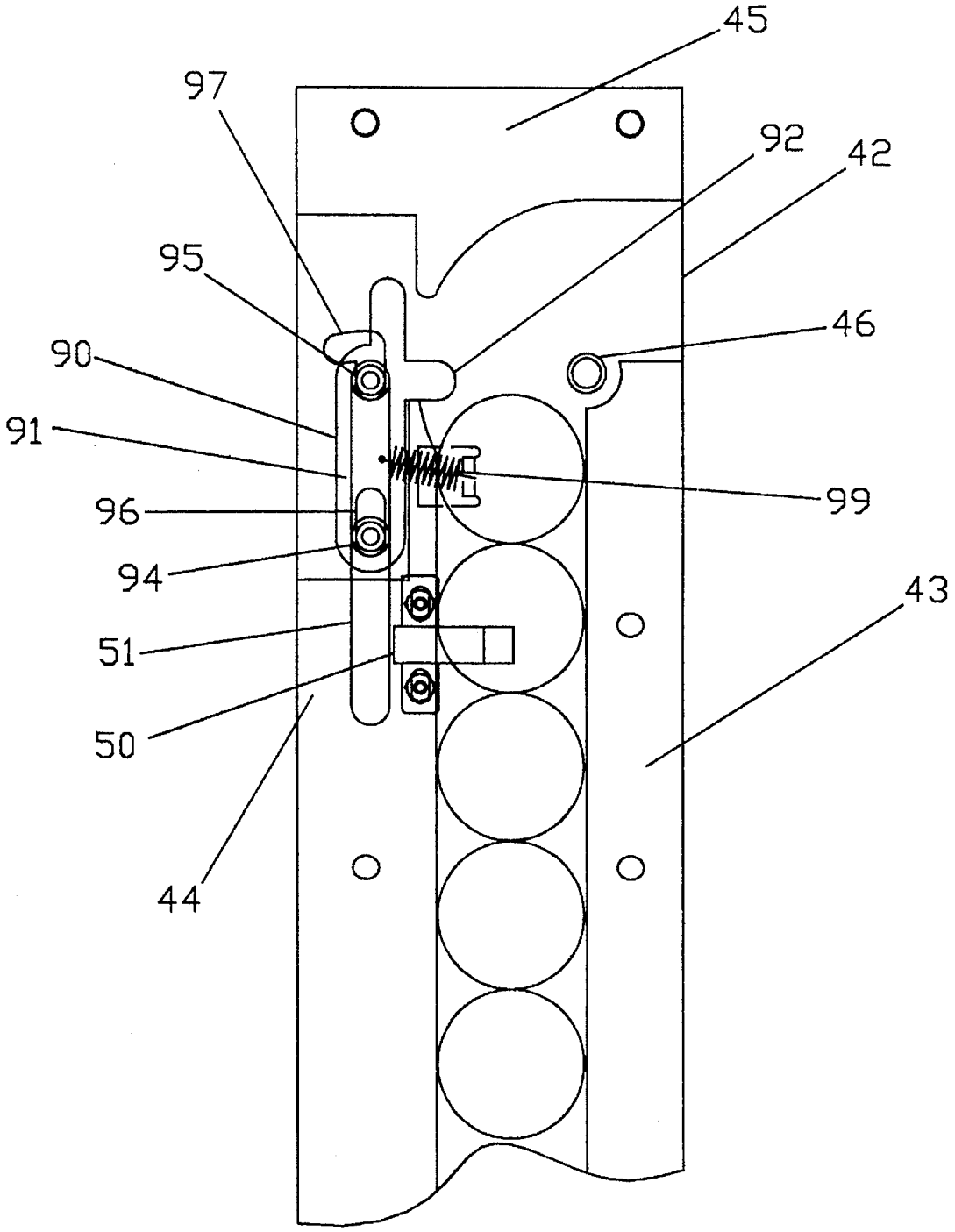
FIGS. 8–11 are partial side views of the upper end of the coin escalator illustrating the interlock function.
Figure 9:
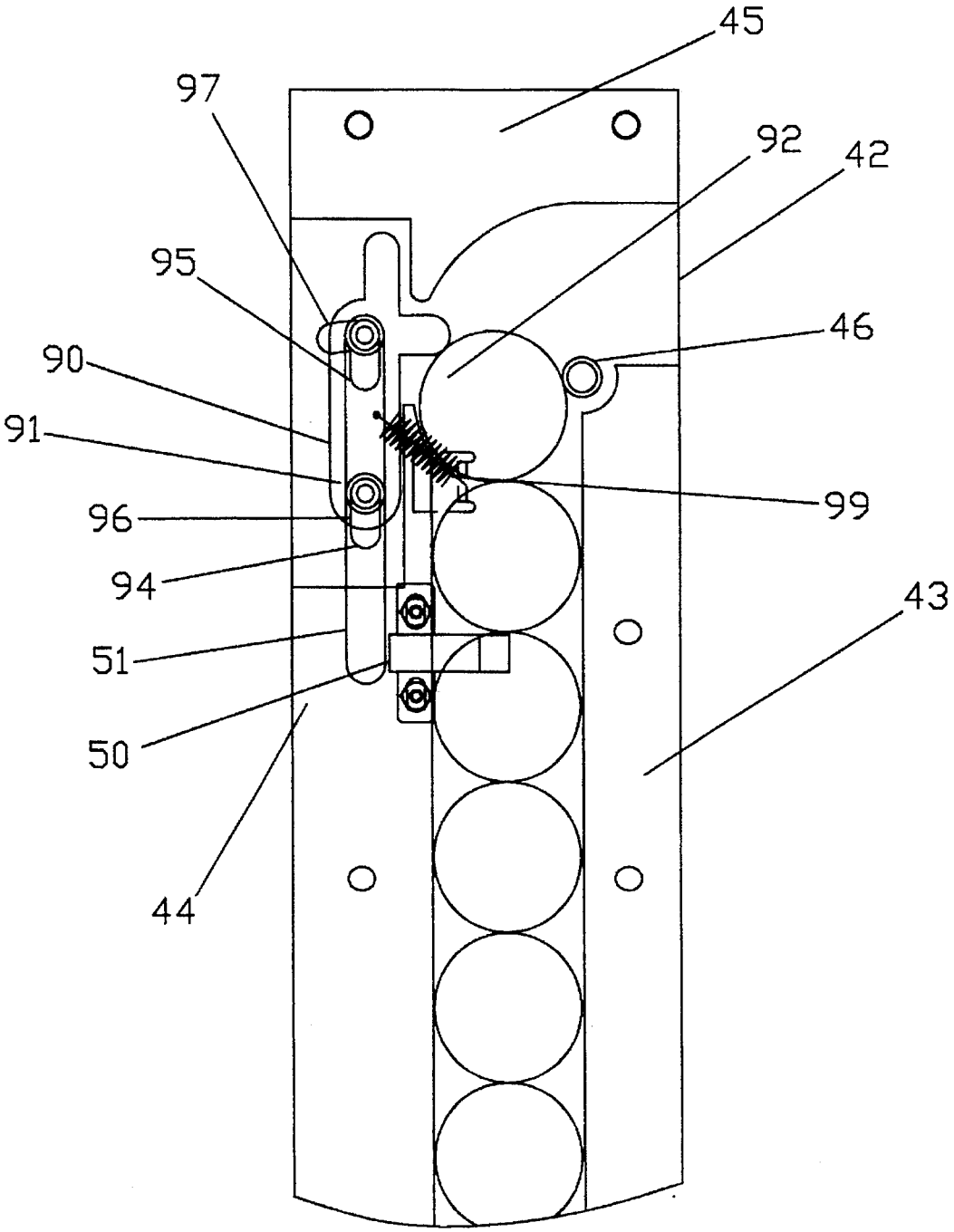
Figure 10:
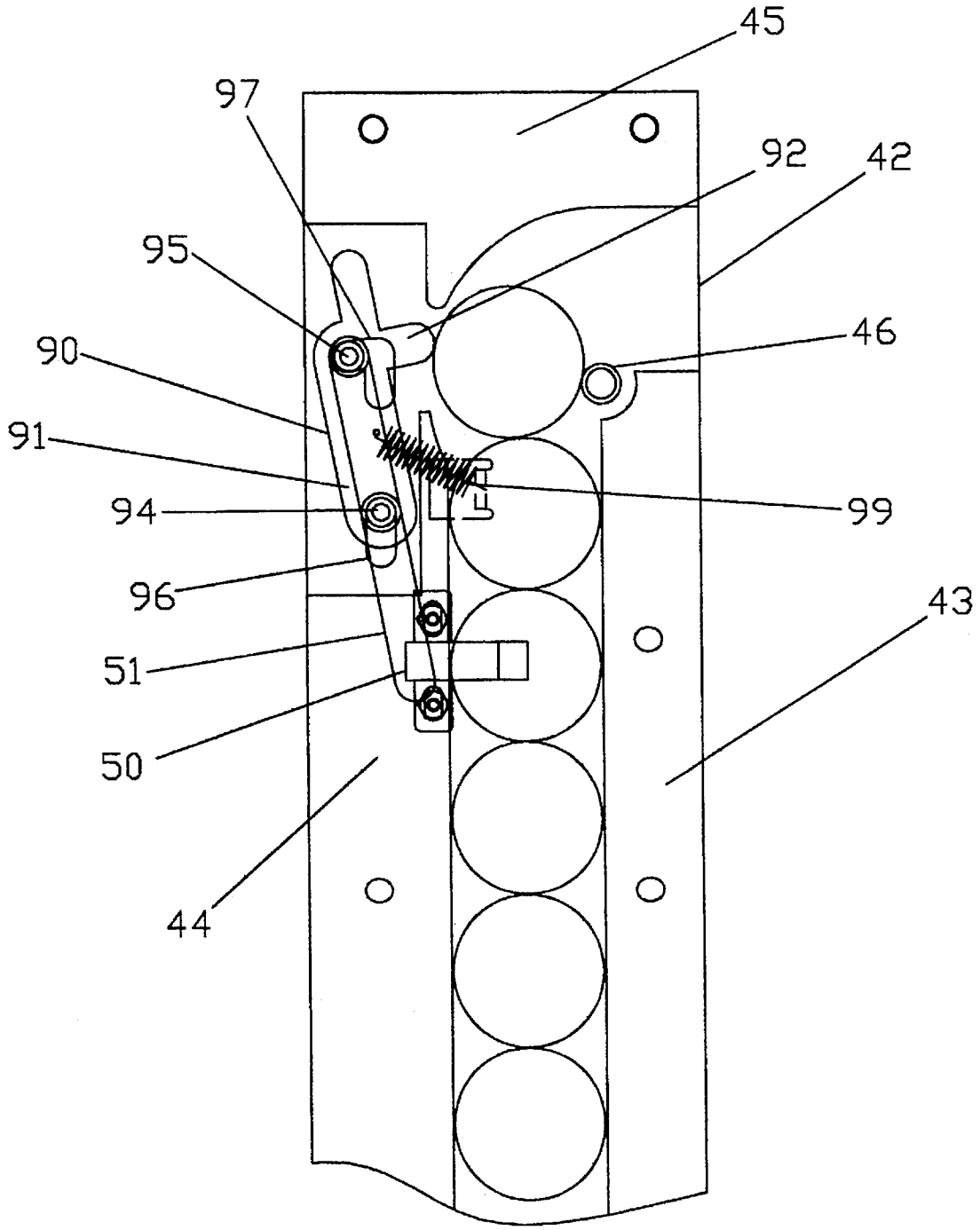
Figure 11:
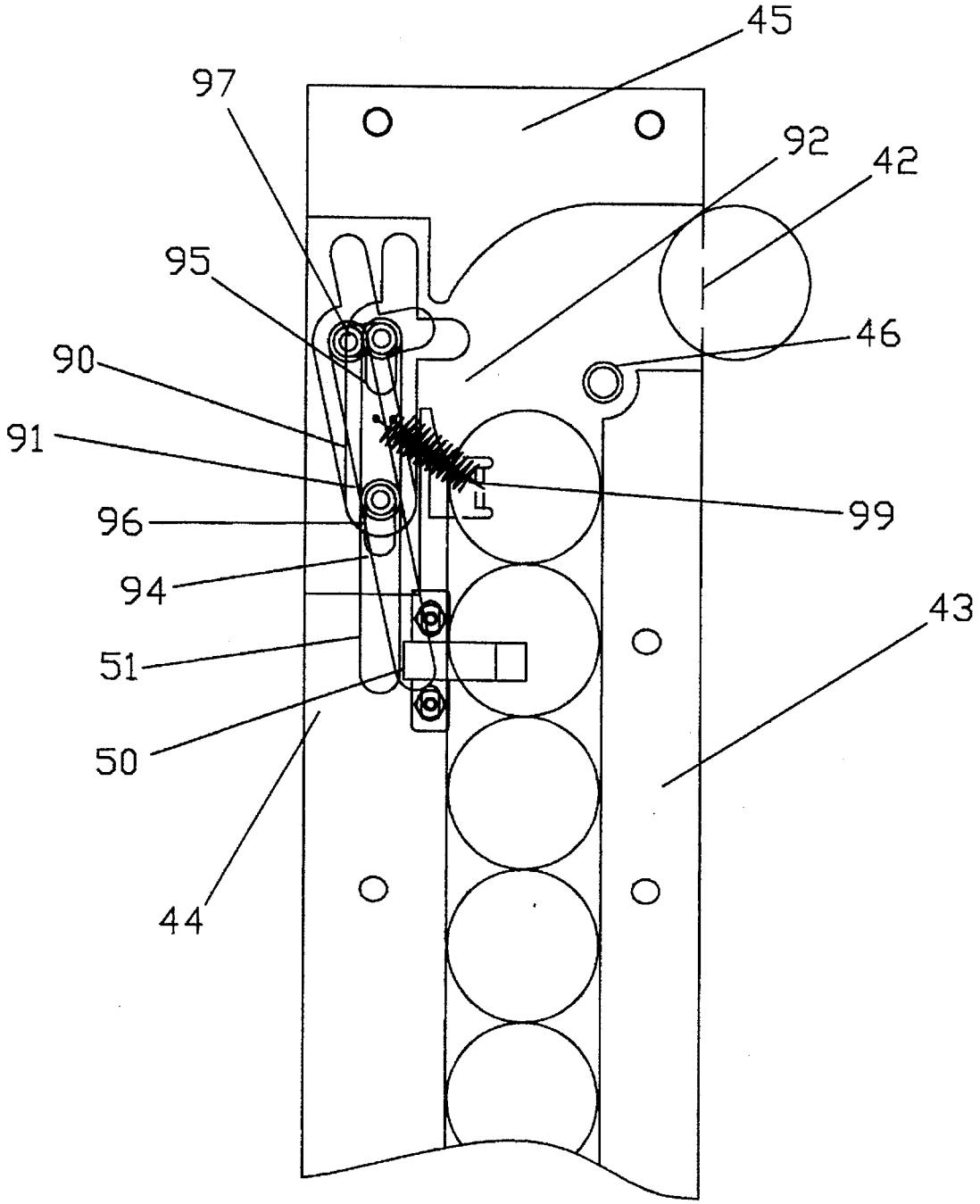
Figure 12:
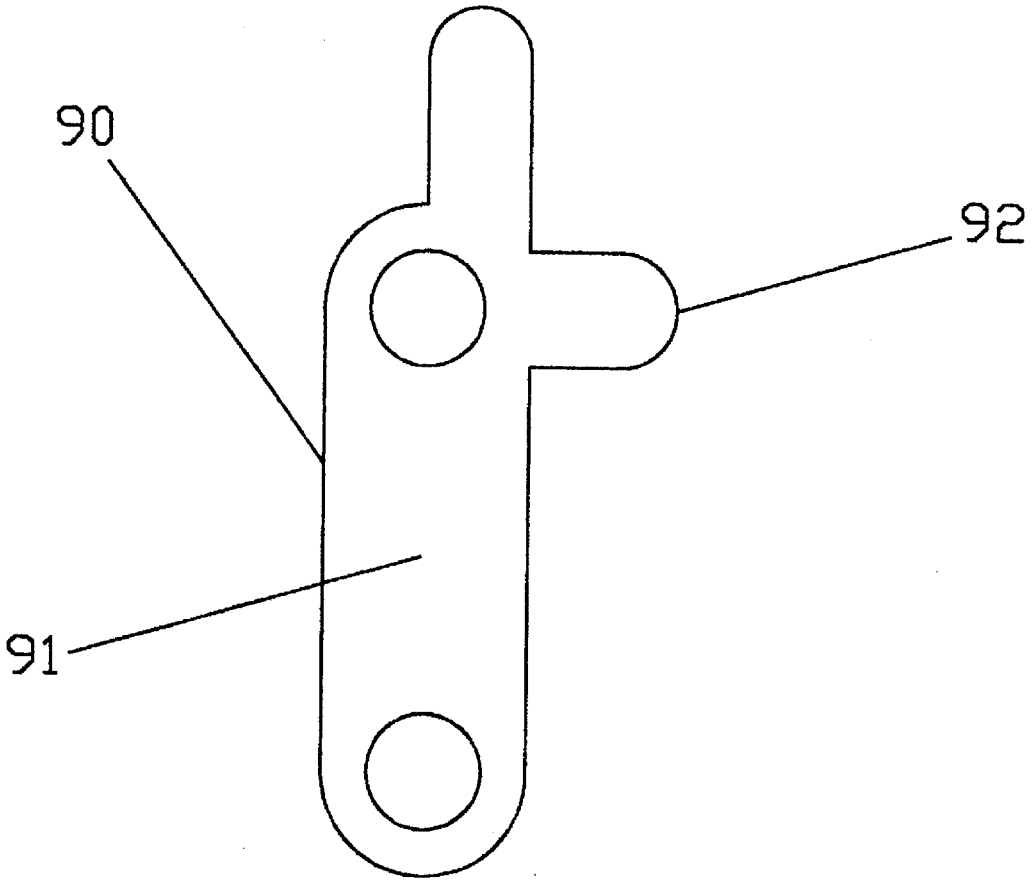
FIG. 12 illustrates interlock member 90.
Figure 13:
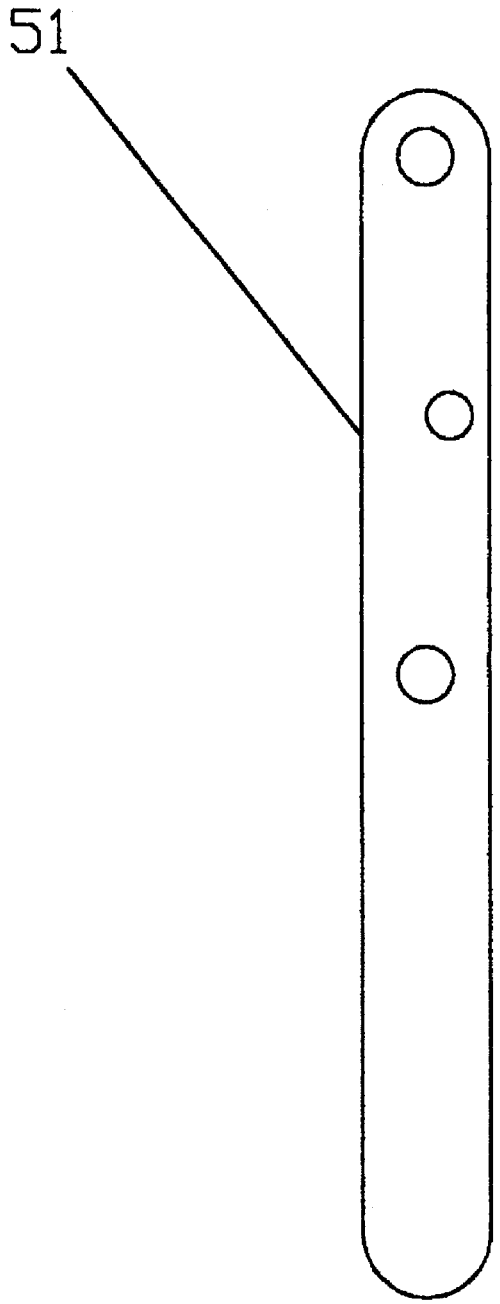
FIG. 13 illustrates counting arm 51.
Figure 14:
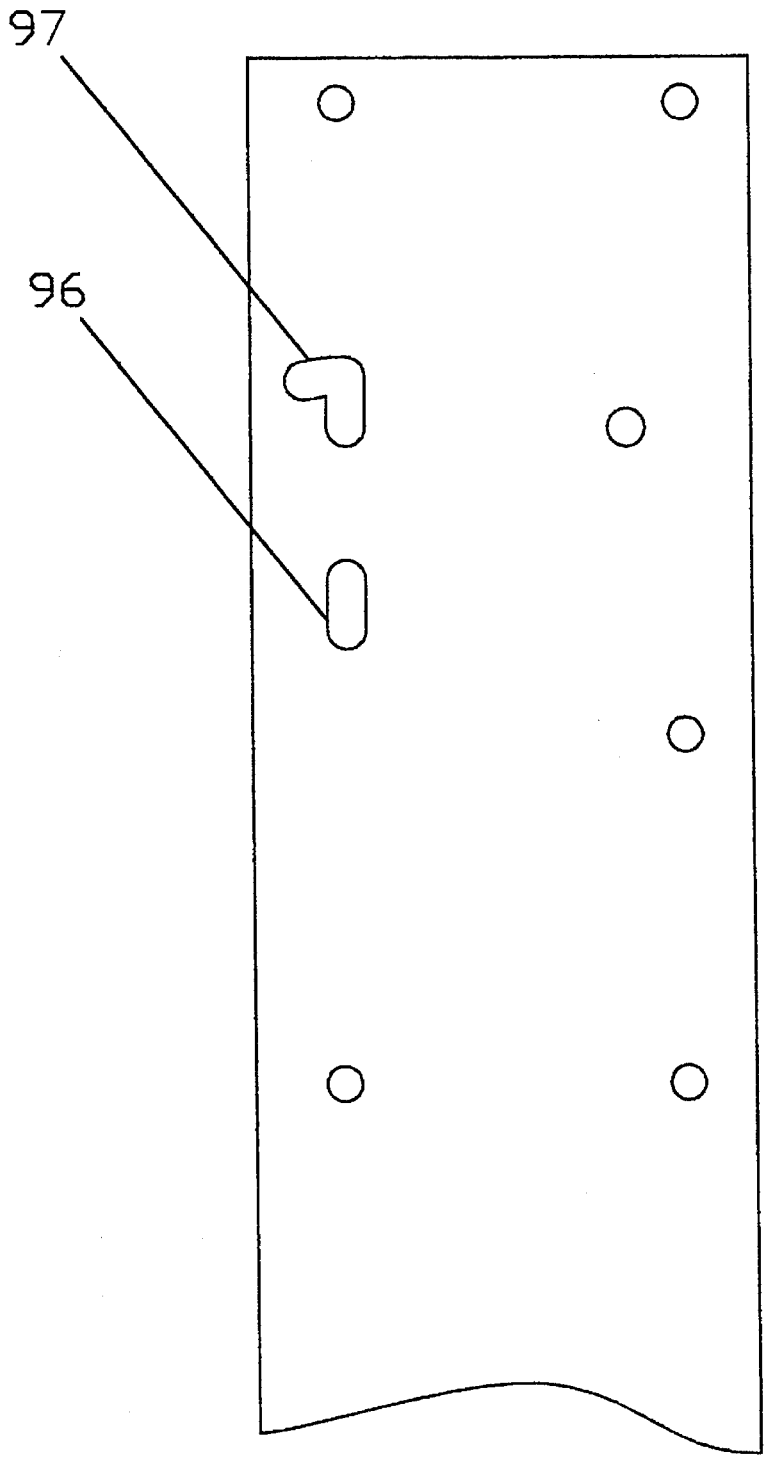
FIG. 14 illustrate interlock grooves 96, 97.

As coins enter the escalator assembly 40, they push the previous coin upward along the chute toward the outlet. Consequently, the escalator, once operation has cycled once, will normally contain coins up to the rotatable abutment stop 46, as illustrated in FIG. 8. In order to prevent theft of coins from the outlet, the mechanical interlock mechanism illustrated in FIGS. 8–11 is provided. As seen in these Figs., an interlock member 90 illustrated in profile in FIG. 12, has a general longitudinally extending body portion 91 and a nose portion 92 extending toward the rotatable abutment member 46 when member 90 is mounted as illustrated. Interlock member 90 is provided with a pair of axles 94, 95, which are received in a pair of grooves formed in each wall 41, 42. Lower groove 96 (see FIG. 14) is generally elongate in shape and provides sliding motion along the length of escalator tower 40 as well as pivoting motion for axle 94. Upper groove 97 has a longitudinally extending portion and a laterally extending portion and thus affords both sliding motion longitudinally of escalator tower 40 and lateral motion in a direction away from the outlet. However, this lateral motion is only afforded at the upper limit of travel of axle 95 in groove 97. A spring 99 normally biases interlock member 90 toward the outlet so that nose portion 92 extends partially across the width of the tower chute and functions in cooperation with fixed rotatable abutment 46 to prevent passage of a coin. However, when a coin 70 is pushed upwardly from the lower stack of coins (in response to coins 70 migrating into the inlet of the escalator tower chute), the coin 70 initially pushes interlock member 90 upward in translatory motion to the position illustrated in FIG. 9, after which further force from below causes interlock member 90 to pivot counterclockwise, as illustrated in FIG. 10. Once the coin passes over center in the upward direction of abutment 46, the nose portion 92 under force of the bias spring 99 ejects the coin through the tower outlet (FIG. 11). Spring 99 further maneuvers the interlock member 90 to the starting position illustrated in FIG. 8. If an attempt is made to lift a coin by inserting an extraction tool, the interlock member 90 cannot be forcibly translated upwardly a sufficient amount to reach the lateral leg of groove 97 due to the angle at which the force must necessarily be directed by the extraction "cool. Consequently, a coin 70 cannot be picked out of the escalator tower by inserting a tool through the outlet.

As will now be apparent, the invention provides a coin handling apparatus which substantially reduces or eliminates coin jamming of any type and the theft of coins from the escalator outlet. Further, the device may be specifically designed for coins of any particular denomination simply by replacing a given coin filter 31 with a different disc having appropriate lands and grooves dimensions, and by changing the size of slot 16 (typically by providing a new hopper assembly 11, 12 tailored to a given coin denomination). Further, the invention is relatively simple in construction and design and therefore relatively easy to assemble and service. It is noted that many of the elements, such as agitator disc 30, coin filter 31 and coin transport disc 32 can be fabricated from molded plastic materials, and thus can be mass produced relatively inexpensively. Also, by use of the interlock mechanism in the escalator tower, the theft of coins can be effectively deterred or entirely eliminated. It is also noted that the optical counter shielding eliminates theft due to flooding the detector with ambient light, while the arrangement of the interlock parts is such that the interlock member 90 cannot be manipulated from the outside surfaces of the escalator tower plates 41, 42.

Figure 15:
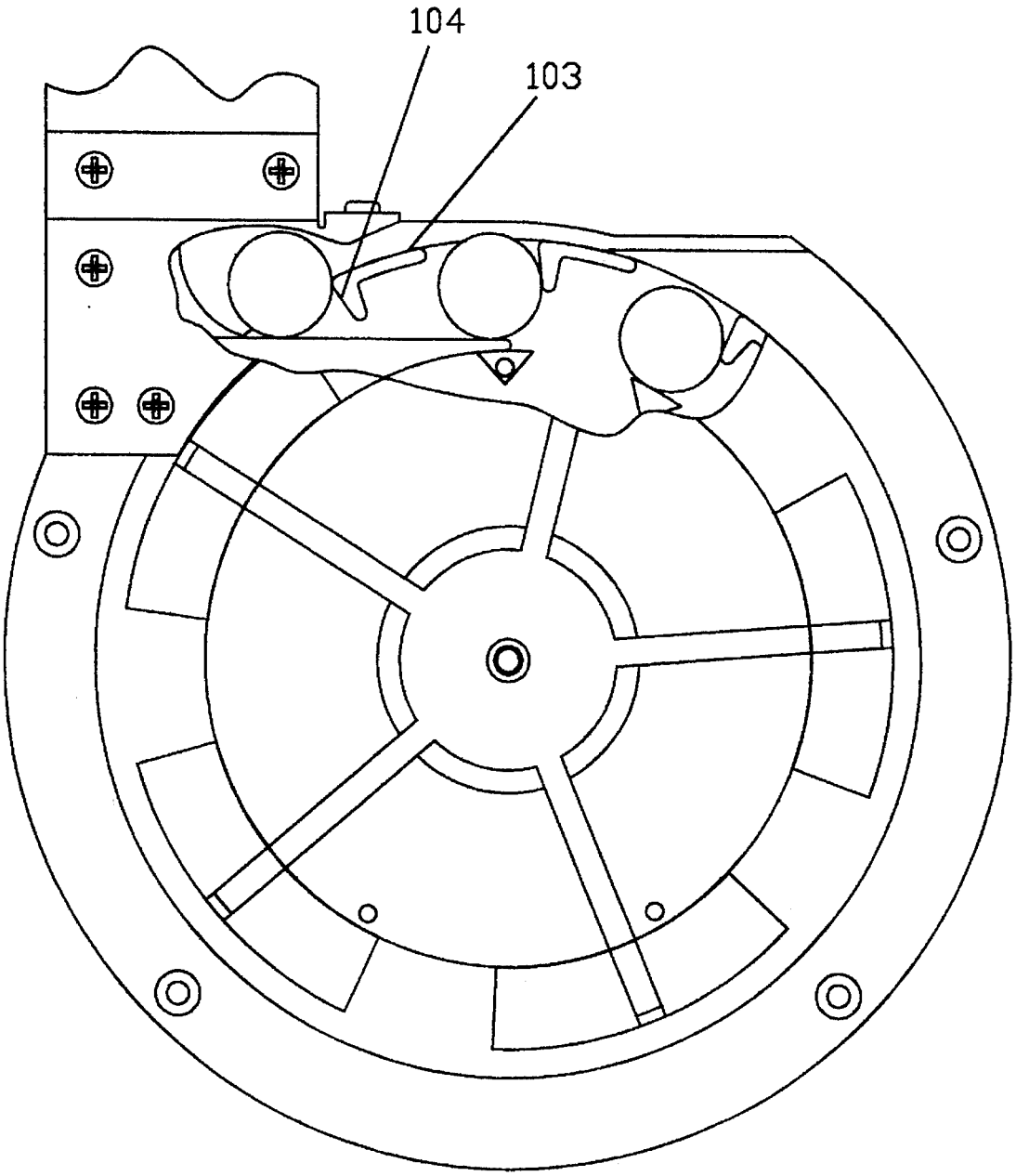
FIG. 15 illustrates an alternate embodiment of the coin stops.

While the above provides a full and complete disclosure of the preferred embodiments of the invention, various modifications, alternate constructions and equivalents may be employed. For example, coin stops 72 having different shapes than those illustrated for segments 72 and pins 73 can be employed, as desired. FIG. 15 illustrates one such variation comprising an L-shaped lug with an arcuate main body portion 103 and a leading edge portion 104. Another variation is a single pin-shaped stop located near the leading edge position of segment 72 Similarly, coin guides 75 having different shapes consistent with the function of those illustrated nay also be employed, such as guides having an arcuate segmental geometry, curved trapezoidal geometry, and single or double pins. Also, the agitator disc 30 and coin filter 31 need not be one piece members of unitary construction, but can be fabricated from individual arms 56 and arm sections 63, as well as lands 62. Alternatively, elements 30 and 31 may be fabricated as a unitary molded member or a unitary machined member, if desired. Further, optoelectronic counter 50 may be replaced by other known coin exit counting mechanisms, such as a microswitch acting in concert with counting arm 51. Therefore, the above should not be construed as limiting the invention, which is defined by the appended claims.

What is claimed is:

1. A coin handling apparatus comprising:

a base member;

a hopper mounted to said base member for storing coins in bulk; and a coin feeder assembly rotatably mounted with respect to said base member for transporting coins from said hopper along a transport path to a transfer station, said coin feeder assembly including an agitator/coin filter device for rejecting coins having a predetermined characteristic, and a coin transport disc secured to said agitator/coin filter device for carrying coins entering through said agitator/coin filter device along said transport path, said agitator/coin filter device comprising an agitator disc portion and a coin filter disc portion having a filter surface facing said agitator disc portion, said filter surface including means for defining coin inlets when said coin filter disc portion is combined with said agitator disc portion.

2. The invention of claim 1 wherein said means for defining coin inlets when said coin filter disc portion is combined with said agitator disc portion comprises lands and grooves forming at least part of said filter surface.

3. The invention of claim 2 wherein said coin filter disc portion has an inner diameter; and wherein said agitator disc portion includes an inner surface, an outer surface and a diameter at least as large as the inner diameter of said coin filter disc portion, said outer surface of said agitator disc portion having a plurality of raised portions extending therealong to promote coin agitation within said hopper.

4. The invention of claim 3 wherein said plurality of raised portions extend radially along said outer surface of said agitator disc portion.

5. The invention of claim 4 wherein said plurality of raised portions extends from the center to the periphery of said outer surface of said agitator disc portion.

6. The invention of claim 2 wherein said coin inlets have predetermined orthogonal dimensions for rejecting coins with at least one of said predetermined characteristics.

7. The invention of claim 6 wherein one of said predetermined characteristics is a coin diameter exceeding the width of said coin inlets.

8. The invention of claim 6 wherein one of said predetermined characteristics is a bent coin.

9. The invention of claim 1 wherein said coin transport disc has a plurality of peripherally distributed coin stops located adjacent the outer diameter of said coin transport disc.

10. The invention of claim 9 wherein said coin stops are pin-shaped.

11. The invention of claim 9 wherein said coin stops are L-shaped.

12. The invention of claim 9 wherein said coin stops comprise an arcuate segment and an associated pin positioned radially inwardly of said segment.

13. The invention of claim 9 further including a plurality of coin guides positioned radially inwardly of said coin stops.

14. The invention of claim 13 wherein said coin guides have an inverted triangular sectional shape.

15. The invention of claim 14 wherein the base of each inverted triangle has an arcuate shape.

16. The invention of claim 1 further including a knife edge secured to said base member and extending laterally along said transfer station.

17. The invention of claim 16 wherein said coin transport disc has a plurality of coin guides positioned radially inwardly of the outer diameter of said disc, each of said coin guides having an arcuate surface at the radial outward end thereof; and wherein said knife edge has an arcuate surface with a radius of curvature closely matched to the radius of curvature of said arcuate surface of each of said coin guides.

18. The invention of claim 1 wherein said agitator/coin filter device and said coin transport disc have facing surfaces arranged along the periphery thereof and defining a registration space for limiting lateral motion of coins transported along said transport path.

19. The invention of claim 1 wherein said base member includes an annular wall extending outwardly therefrom with a diameter sized to minimize inward movement of said coin transport disc.

20. The invention of claim 19 wherein said coin transport disc includes a plurality of coin guides positioned radially inwardly of the outer diameter of said disc, each of said coin guides having a guide surface at the outer end thereof for limiting inward radial motion of coins transported along said transport path.

21. The invention of claim 1 wherein said hopper includes a coin slot at a location in registration with said coin feeder assembly, said slot having dimensions selected to accommodate an undersized coin.

22. The invention of claim 21 wherein said coin slot is located adjacent the bottom position of said coin feeder assembly as viewed axially.

23. The invention of claim 1 wherein said coin handling apparatus further includes a coin escalator secured to said base member adjacent said transfer station for providing ejection of coins in serial fashion at a location removed from said transfer station.

24. The invention of claim 23 wherein said coin escalator includes a housing with inner wall surfaces defining a coin chute having an inlet adjacent said transfer station and an outlet; and a coin interlock mechanism adjacent said outlet, said coin interlock mechanism including an interlock bar slidably and pivotally mounted to said coin escalator within said chute, said interlock bar having a protruding nose portion extending towards said outlet, and bias means coupled to said interlock bar for biasing said interlock bar to a position in which said nose portion extends partially across said chute to a coin blocking position.

25. The invention of claim 24 wherein said housing is provided with a pair of guide grooves adjacent said outlet, a first lower one of said guide grooves having a shape permitting motion generally parallel to said chute and a second upper one of said guide grooves having a shape permitting both motion generally parallel to said chute and motion laterally of said chute in a direction away from said outlet; and wherein said interlock bar has a pair of axles arranged for sliding and pivoting motion within said guide grooves.

26. The invention of claim 24 further including a rotatable interference stop extending laterally of said chute at said outlet and positioned opposite said interlock mechanism.

27. The invention of claim 1 wherein said agitator disc portion and said coin filter disc portion are separate elements.

28. The invention of claim 1 further including means coupled to said base member for limiting outward movement of said coin feeder assembly.

29. For use in a coin hopper used to transport coins from a coin mass volume to a transfer station, a coin feeder assembly comprising:

an agitator/coin filter device for rejecting coins having a predetermined characteristic, said agitator/coin filter device comprising an agitator disc portion and a coin filter disc portion having a filter surface facing said agitator disc portion, said filter surface including means for defining coin inlets when said coin filter disc portion is combined with said agitator disc portion; and a coin transport disc secured to said agitator/coin filter device and having a plurality of peripherally distributed coin stops located adjacent the outer diameter of said disc for receiving coins passing through said agitator/coin filter device.

30. The invention of claim 29 wherein said means for defining coin inlets when said coin filter disc portion is combined with said agitator disc portion comprises lands and grooves forming at least part of said filter surface.

31. The invention of claim 30 wherein said coin filter disc portion has an inner diameter; and wherein said agitator disc portion includes an inner surface, an outer surface and a diameter at least as large as the inner diameter of said coin filter disc portion, said outer surface of said agitator disc portion having a plurality of raised portions extending therealong to promote coin agitation within the hopper.

32. The invention of claim 31 wherein said plurality of raised portions extends radially along said outer surface of said agitator disc portion.

33. The invention of claim 32 wherein said plurality of raised portions extends from the center to the periphery of said outer surface of said agitator disc portion.

34. The invention of claim 30 wherein said coin inlets have predetermined orthogonal dimensions for rejecting coins with at least one of said predetermined characteristics.

35. The invention of claim 34 wherein one of said predetermined characteristics is a coin diameter exceeding the width of said coin inlets.

36. The invention of claim 34 wherein one of said predetermined characteristics is a bent coin.

37. The invention of claim 29 wherein said coin stops are pin shaped.

38. The invention of claim 29 wherein said coin stops are L-shaped.

39. The invention of claim 29 wherein said coin stops comprise an arcuate segment and an associated pin positioned radially inwardly of said segment.

40. The invention of claim 29 further including a plurality of coin guides positioned radially inwardly of said coin stops.

41. The invention of claim 40 wherein said coin guides have an inverted triangular sectional shape.

42. The invention of claim 41 wherein the base of each inverted triangle has an arcuate shape.

43. The invention of claim 29 wherein said agitator disc portion and said coin filter disc portion are separate elements.

44. For use with a coin handling apparatus, a coin escalator for providing serial ejection of coins, said escalator comprising:

a housing with inner wall surfaces defining a coin chute having an inlet for receiving coins an outlet and a pair of guide grooves adjacent said outlet, a first lower one of said guide grooves having a shape permitting motion generally parallel to said chute and a second upper one of said guide grooves having a shape permitting both motion generally parallel to said chute and motion laterally of said chute in a direction away from said outlet; and a coin interlock mechanism adjacent said outlet, said coin interlock mechanism including an interlock bar slidably and pivotally mounted within said guide grooves, said interlock bar having a protruding nose portion extending towards said outlet, and bias means coupled to said interlock bar for biasing said interlock bar to a position in which said nose portion extends partially across said chute to a coin blocking position.

45. The invention of claim 44 further including a fixed position, rotatable interference stop extending laterally of said chute at said outlet and positioned opposite said interlock mechanism.

* * * * *